US005751330A

United States Patent [19]

Austin et al.

[11] Patent Number: 5,751,330

[45] Date of Patent: May 12, 1998

[54] PRINTER FOR PRINTING ON MEDIA ROLL

[75] Inventors: Pixie Ann Austin, Marysville; Christopher A. Wiklof; Cathy L. Aragon, both of Everett, all of Wash.

[73] Assignee: Intermec Corporation

[21] Appl. No.: 454,503

[22] Filed: May 30, 1995

[51] Int. Cl.[6] ..... B41J 2/32

[52] U.S. Cl. ..... 347/171; 347/222

[58] Field of Search ..... 400/88, 120.01; 347/171, 222; 358/471, 472, 473

[56] References Cited

U.S. PATENT DOCUMENTS

| | | | |
|---|---|---|---|
| 3,767,020 | 10/1973 | Rowe | 197/1 R |
| 4,372,695 | 2/1983 | Ross | 400/119 |
| 4,427,314 | 1/1984 | Fujiwara et al. | 400/338.2 |
| 4,433,925 | 2/1984 | Fujiwara et al. | 400/88 |
| 4,523,235 | 6/1985 | Rajchman | 358/256 |
| 4,547,780 | 10/1985 | Cummins | 346/9 |
| 4,699,052 | 10/1987 | Lemelson | 101/110 |
| 4,750,049 | 6/1988 | Murakami et al. | 358/296 |
| 4,819,083 | 4/1989 | Kawai et al. | 358/294 |
| 4,851,896 | 7/1989 | Muranaga et al. | 358/443 |
| 4,851,921 | 7/1989 | Sato et al. | 358/474 |
| 4,862,281 | 8/1989 | Sato et al. | 358/400 |
| 4,887,165 | 12/1989 | Sato et al. | 358/474 |
| 4,894,730 | 1/1990 | Yanagawa et al. | 358/473 |
| 4,899,228 | 2/1990 | Sano et al. | 358/473 |
| 4,903,232 | 2/1990 | O'Connell et al. | 364/900 |
| 4,915,027 | 4/1990 | Ishibashi et al. | 101/486 |
| 4,928,183 | 5/1990 | Yajima | 358/296 |
| 4,947,262 | 8/1990 | Yajima et al. | 358/296 |
| 4,949,283 | 8/1990 | Yamauchi et al. | 364/519 |
| 4,999,016 | 3/1991 | Suzuki et al. | 400/88 |
| 5,020,928 | 6/1991 | Akiyama et al. | 400/193 |
| 5,024,541 | 6/1991 | Tsukada et al. | 400/88 |
| 5,052,832 | 10/1991 | Akiyama et al. | 400/120 |
| 5,079,639 | 1/1992 | Mochinaga | 358/473 |
| 5,112,149 | 5/1992 | Suenaga | 400/88 |
| 5,131,090 | 7/1992 | Fukushima | 395/700 |
| 5,240,334 | 8/1993 | Epstein et al. | 400/88 |

FOREIGN PATENT DOCUMENTS

| | | |
|---|---|---|
| 61-035391 | 2/1986 | Japan . |
| 63-290780 | 11/1988 | Japan . |

OTHER PUBLICATIONS

Schweihs et al. , "Platenless Nonimpact Printer", IBM Disclosure Bulletin, vol. 22 No. 1 Jun. 1979, pp. 278–79.

*Primary Examiner*—Huan H. Tran
*Attorney, Agent, or Firm*—Seed and Berry LLP

[57] ABSTRACT

A printer for printing on an outer layer of a print medium on a print medium roll. The printer may use thermal or inkjet printing. The printer is used without a mechanical paper drive mechanism. The printer monitors movement of an outer wrap of the print medium as the print medium roll rotates in response to a user pulling print medium from the print medium roll. In one embodiment, the printer detects movement of the print medium with a metering roller and an optical rotation sensor. In another embodiment, the printer monitors movement of the print medium by detecting movement of index marks on the print medium. From the monitored movement of the print medium, the printer identifies a portion of the print medium aligned to the printhead and selects image portions to print in the identified portion. The printer then activates the printhead to print the selected image portions in the corresponding identified portion. A bias spring, together with movable mounting of the printhead, allows the printhead to remain engaged with the print medium as the radius of the print medium roll decreases as the print medium is dispensed.

22 Claims, 5 Drawing Sheets

PRINTER FOR PRINTING ON MEDIA ROLL

TECHNICAL FIELD

The present invention relates to printers such as printers used for printing bar code symbologies and other images.

BACKGROUND OF THE INVENTION

Typically, printers require a supply of a print medium, such as paper, to be loaded into the printer and controllably moved through the printer. The paper is typically supplied as either a continuous stream of paper or as individual sheets. The paper is fed into the printer using a set of drive rollers which frictionally engage the paper and propel it through the printer along a predetermined path. The drive rollers often are driven by a stepper motor which drives the drive rollers in small increments or steps such that the paper is propelled incrementally or stepped through the printer, pausing slightly between each step. As the paper is stepped through the printer, it passes a conventional printhead having a linear array of elements, such as a thermal printhead or an inkjet printhead. During each pause between steps, a small portion of the paper is aligned with the printhead and selected elements of the printhead are activated to produce a portion of an image on the portion of the paper aligned with the printhead.

This image portion is a small portion of an entire image to be printed. The entire image typically is produced by stepping the paper past the printhead, pausing the paper after each step, determining a step number (e.g., fifth step or sixth step) corresponding to the pause, determining the portion of the image corresponding to the step number, determining which elements of the printhead to activate to produce the determined portion of the image, and activating the determined elements to produce the determined portion of the image on the paper. A microprocessor controls the operation.

To produce the entire image accurately, the distance the paper is propelled for each step must be controlled precisely. Further, the step number must be monitored continuously to enable the location of the paper relative to the printhead to be precisely determined.

This control of the paper position and monitoring of the step number is typically achieved with a stepper motor with precisely defined step sizes and by digitally controlling the stepper motor with a microprocessor motor controller. The timing of the printer must also be controlled accurately, so that the printhead is activated during the pauses between steps.

The need for such stepper motors, digital controllers and timing control greatly increase the weight, complexity and cost of printers. Also, monitoring the step number and correlating it to the controlled stepping of the stepper motor and the image portion requires considerable microprocessor time.

SUMMARY OF THE INVENTION

The present invention overcomes the limitations of the prior art by providing a printer capable of printing relatively complex images of indefinite and variable size and a high degree of uniformity directly onto a print medium on a print roll without requiring an accurately controlled stepper motor or other mechanical print medium or other controllable print media feed source with its associated weight, complexity, cost, and interface and processing requirements.

The print medium may be propelled by hand from outside of the printer. The means of propelling the print medium through the printer is independent of electronic control by the printer. By divorcing the print medium driving means from the printer electronic control, the printer eliminates the need for a printer-to-print medium drive interface.

The printer in its preferred embodiment determines the position of the print medium mechanically by engaging a first roller to an outer wrap of the print medium roll and coupling the first roller to a rotational sensor. Based upon the detected rotation of the print medium roll, the printer identifies a small field on the outer layer of the print medium aligned with the printhead and a corresponding image portion to be printed on the field. The printhead is then energized in response to the identified image portion to print the image portion. The process is repeated for successive image portions until an entire image is printed.

In an alternative embodiment, the printer measures the print medium position by optically monitoring index marks on the print medium roll. The printer then calculates the position of the print medium from these measurements.

Because the printer detects the position of the print medium directly, no mechanical print medium drive or other controllable print media feed source is required. The printed image achievable with the printer is not limited in size to the printing element size. Because the printer uses an accurate, location-based printhead activation, it provides a uniform, repeatable image. The printer can therefore be used to print bar codes and other images of varying lengths.

DETAILED DESCRIPTION OF THE INVENTION

Figures 1A, 1B:
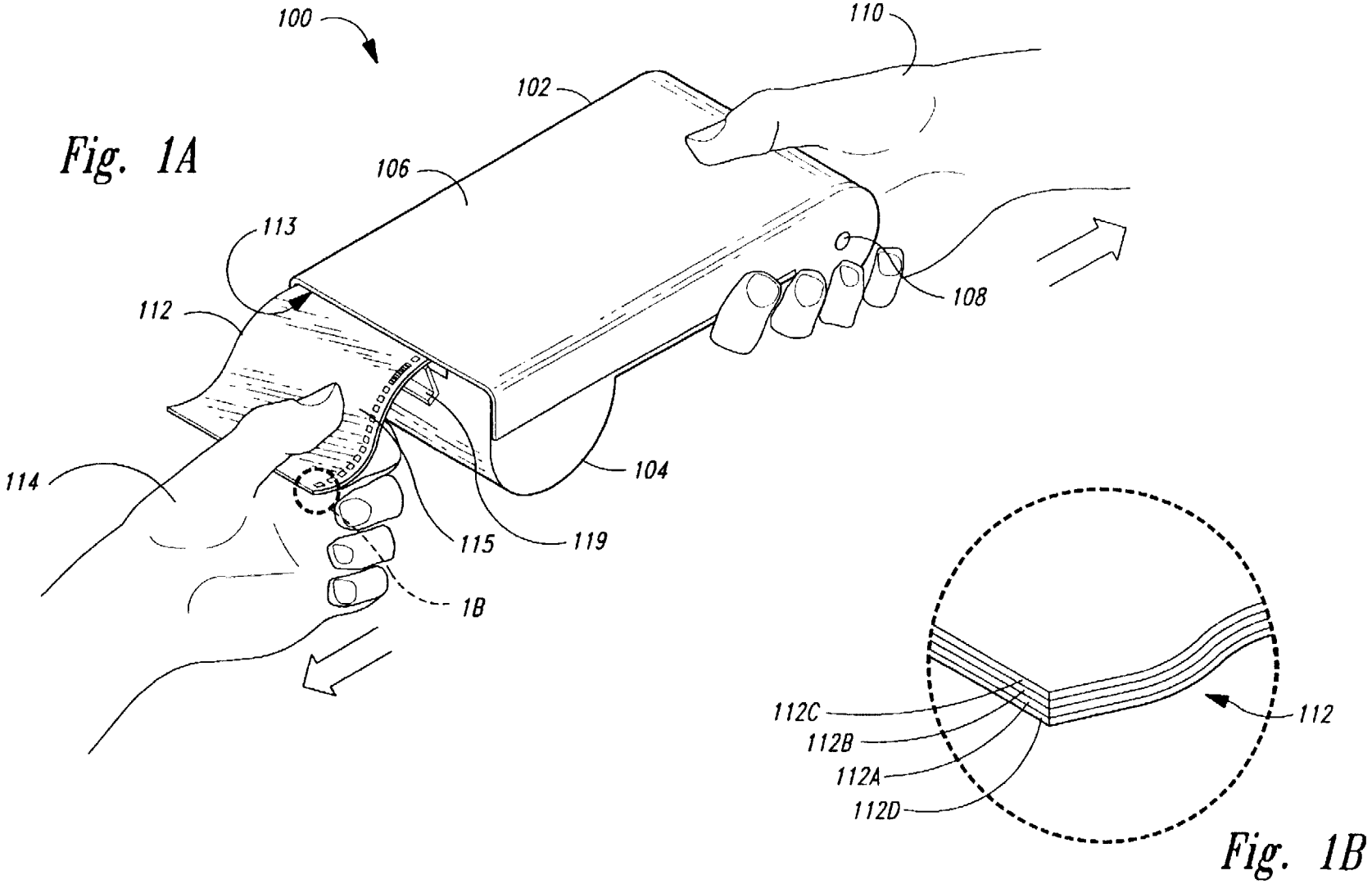
FIG. 1A is an isometric view of a preferred embodiment of the inventive printer showing a user pulling a print medium from the printer.
FIG. 1B is an enlarged detail view of a portion of the print medium of FIG. 1A showing four layers of the print medium.

A printer 100 according to the present invention, shown in FIG. 1A includes a housing 102 having a base 104 and a cover 106 pivotably connected together by a pivot pin 108 in a "clamshell" configuration. The housing 102 has a curved shape for ease of grasping by a first hand 110 of a user.

As will be seen from the following discussion, the printer 100 does not require a stepper motor and associated control electronics to print an image. Instead, the printer 100 detects motion of a print medium 112 as it is pulled through a paper port 113 from the printer 100 by a second hand 114 of the user, which grabs a free end 115 of the print medium 112. Based upon the detected motion of the print medium 112 as it is being pulled, the printer 100 identifies successive portions of the print medium 112 and prints a portion of an image on each successive print medium portion. Together, the successive image portions form an entire image, such as a bar code symbol.

Figure 2:
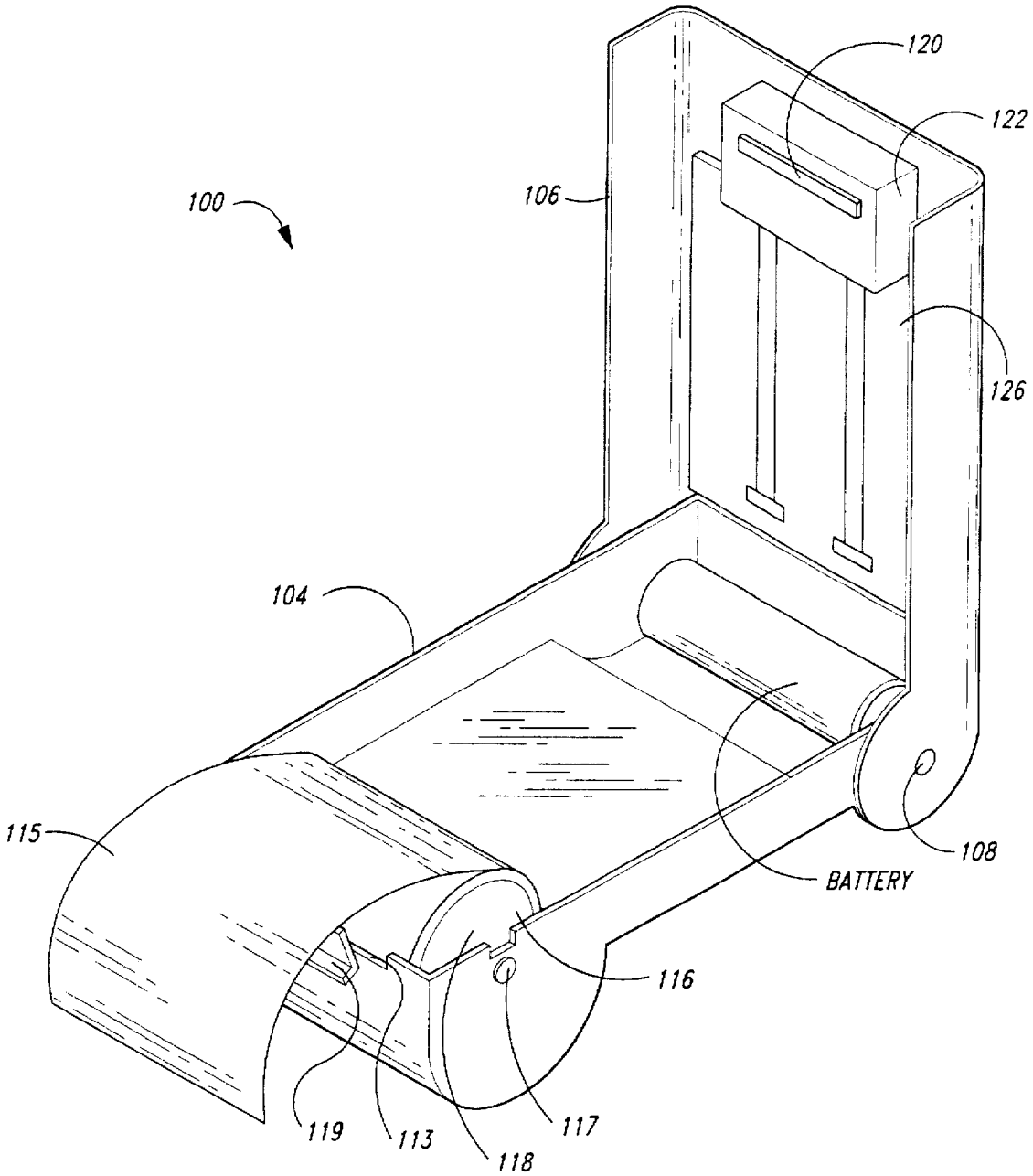
FIG. 2 is an enlarged isometric view of the printer of FIG. 1 with a cover open to expose internal components of the printer.

The printer 100 of FIG. 1A is presented in FIG. 2 with the cover 106 rotated about the pivot pin 108 to its open position to expose the internal components of the printer. A print medium roll 116 on which the print medium 112 originally resides is carried by the base 104 and rotatably supported by a roll axle 117 to provide a continuous length of the print medium 112. The print medium 112 is a linerless thermal medium having a series of labels linked end-to-end. The print medium 112 is wound around a hollow cylindrical core 118 to form the print medium roll 116. The core 118 is rotatably carried by the roll axle 117, which passes through the hollow center of the core, providing support while allowing the print medium roll 116 to rotate as the print medium 112 is dispensed.

As can be seen in FIG. 1B, the linerless thermal print medium 112 is a four-layer structure having as its middle two layers a paper base layer 112A with a thermally sensitive top layer 112B. A radiation-cured silicone coating 112C (shown to exaggerated scale) forms a protective shield to protect the thermally sensitive top layer 112B. A description of such a linerless thermal print medium can be found in U.S. Pat. No. 4,604,635 to Wiklof et al., which is incorporated herein by reference. An adhesive 112D (shown to exaggerated scale) coats the lower surface of the paper base layer 112A to allow the print medium 112 to be attached to a package or other object.

Alternatively, a thermally sensitive print ribbon with a ribbon take-up roll, as is conventional for thermal printers, may be used in conjunction with a conventional paper in place of the linerless thermal print medium. Moreover, while a printhead 122 used in the printer 100 is preferably a thermal printhead, other printing heads, such as inkjet printheads may be used. In such embodiments, the print medium 112 need not include a thermally sensitive layer or ribbon.

The print medium 112 that is dispensed from the print medium roll 116 exits the housing 102 through the label port 113 formed between the base 104 and the cover 106 where the free end 115 is accessible for grasping by the second hand 114 of the user to pull the print medium 112 from the print medium roll. To tear away sections of the print medium 112 the user pulls downwardly on the print medium, forcing the print medium against a tear bar 119 carried by the base 104 adjacent to the label port 113. The tear bar 119 is a sharpened metal bar similar to a tear bar on a common transparent tape dispenser.

Figure 3:
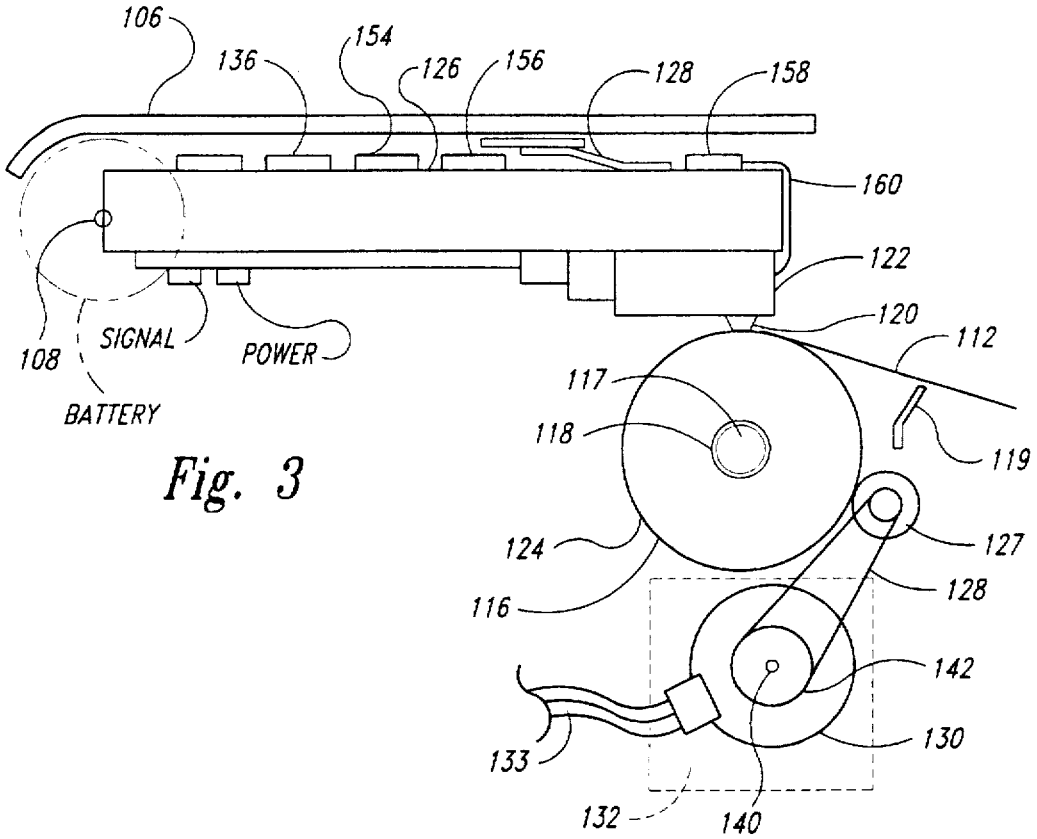
FIG. 3 is a schematic side elevational drawing of a portion of the printer of FIG. 1 showing the printhead resiliently engaging an outer layer of a print medium roll.

As can be seen in the detail view of the printing and motion-monitoring portion of the printer 100 shown in FIG. 3, the cover 106 carries a linear array of print elements 120 within the conventional thermal printhead 122 on a printed circuit board 126. When the cover 106 is closed, the array of print elements 120 engages an outer wrap 124 of the print medium 112 at the silicone coating 112C. The printhead 122 is held in thermal contact with the print medium 112 by engagement pressure between the printhead and the print medium roll 116.

To maintain the engagement of the printhead 122 with the print medium 112, the printed circuit board 126 bearing the printhead is movably supported by the cover 106 and biased to move toward the print medium roll 116 by a spring 128 positioned between the cover and the printed circuit board. As the user pulls the print medium 112 from the printer 100, the print medium is consumed and the diameter of the print medium roll 116 is reduced. The biasing force of the spring 128 causes the printed circuit board 126 carrying the printhead 122 to move toward the print medium roll 116 with the printhead aligned to move on a radial path toward the print roll axle 117 with the printhead 122 remaining engaged with the print medium roll 116.

The printing process used by the printer 100 may be divided into three related aspects, first, detection of movement of the print medium 112 to determine the portion of the print medium aligned with the printhead 122; second, identification of an image portion to be printed on the determined portion of the print medium; and third, activation of the printhead to print the image portion on the determined portion of the print medium.

The first aspect of the printing process, detection of the print medium movement, is initiated when the print medium 112 is pulled by the user's second hand 114 which grasps and pulls the protruding free end 115 of the print medium 112, causing the print medium roll 116 to turn. The rotation of the print medium roll 116 is translated through frictional engagement to rotation of a metering roller 127 as shown in FIG. 3. In turn, rotation of the metering roller 127 is translated by a belt 128 into rotation of an encoder wheel 130 within a rotation sensor 132. In the manner discussed in greater detail below with respect to FIG. 4, the rotation sensor 132 converts the rotational movement of the metering roller 127 and corresponding rotation of the encoder wheel 130 into a digital electrical signal indicative of rotation of the print medium roll 116. The digital signal from the rotation sensor 132 is carried by a cable 133 to the printed circuit board 126. There, the digital signal is input to a microprocessor 136 on the printed circuit board 126. The microprocessor 136 decodes the digital signal indicative of the rotation of the print medium roll 116 and from the decoded information, determines the portion of the print medium 112 aligned to the printhead 122.

Figure 4:
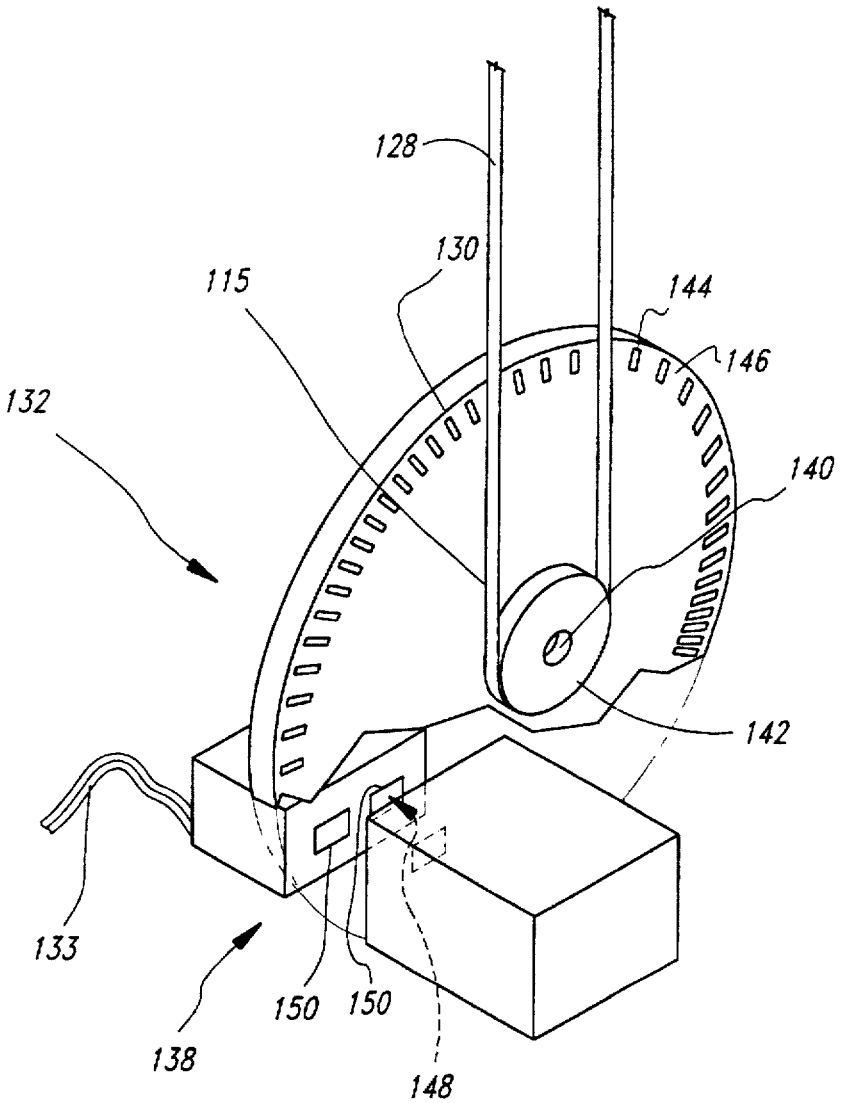
FIG. 4 is an enlarged fragmentary view of a rotation sensor used in the printer of FIG. 1.

The measurement of rotation of the print medium roll 116 by the rotation sensor 132 is best demonstrated by reference to FIG. 4. The rotation sensor 132 includes two main components, the encoder wheel 130 and an optical detector 138 for monitoring the rotation of the encoder wheel. The encoder wheel 130 is mounted on an encoder axle 140 coaxially with an encoder pulley 142. The encoder pulley 142 is coupled to the metering roller 127 (FIG. 3) by the belt 128 to turn in correspondence with the metering roller. As the print medium roll 116 turns, the metering roller 127 is turned through its frictional engagement with the print medium roll. As the metering roller 127 turns, the encoder pulley 142 and encoder wheel 130 turn with it.

Alternating transmissive and opaque regions 144 and 146, respectively, are circumferentially spaced along the perimeter of the encoder wheel 130. The optical detector 138 includes an optical source 148 (shown in broken line) and a pair of optical receivers 150 to monitor the movement of the transmissive and opaque regions 144 and 146, giving an indication of rotation of the encoder wheel 130. The optical source 148 and optical receivers 150 are a conventional light-emitting diode (LED) and photo detectors, respectively, which are positioned such that the transmissive and opaque regions 144 and 146 of the encoder wheel 130 pass between the optical source and receivers. As the encoder wheel 130 turns, light from the optical source 148 is alternately transmitted through the transmissive regions 144 to the receivers 150 and blocked by the opaque regions 146 producing an alternating light signal to the receivers 150. In response to the alternating light, the receivers 150 produce signals corresponding to the angular rotation of the encoder wheel 130 which correspond to the rotation of the print medium roll 116. The rotation sensor 132 thus produces an electrical signal indicative of the rotation of the print medium roll 116 for input to the microprocessor 136 (see FIG. 3).

Referring again to FIG. 3, the microprocessor 136 monitors the signals from the rotation sensor 132 and calculates the distance traveled by the print medium 112. To calculate the distance traveled by the print medium 112, the microprocessor 136 first identifies a starting location, such as the start of a label or an arbitrarily selected start of an image location. The microprocessor 136 then monitors the signals from the rotation sensor 132 to calculate the distance traveled by the print medium.

From the determination of the traveled distance, the microprocessor 136 determines when successive portions of the print medium 112 are aligned with the printhead 122 for printing. The microprocessor 136 then determines a desired image portion to be printed on each successive portion of the print medium 112 and identifies an appropriate energization signal for the printhead 122 to produce the desired image portion.

To identify the desired image portion to be printed, the microprocessor 136 retrieves data from a bit map of image data stored in a memory 154 having several memory locations, each corresponding to a pixel of the image. Each memory location contains a data bit or sequence of data bits corresponding to the memory location's respective individual pixel, with each such data bit or sequence of data bits representing the printing or not printing of the pixel. For example, a logic level "1" may correspond to printing the particular pixel and a logic level "0" may correspond to not printing the particular pixel. The pixels of the image thus map in a one-to-one relationship to locations in the memory 154 containing data bits (i.e., a "bitmap").

The data is retrieved from the memory 154 on a line-by-line basis. That is, a data bit or sequence of data bits for each element in the array of print elements 120 of the printhead 122 is retrieved and loaded as a group into a buffer 156 for printing. The portion of the print medium 112 with which the printhead 122 is aligned contains a plurality of regions, each aligned to one of the print elements 120. All of the print elements 120 may be activated simultaneously to print a narrow portion (i.e., a line) of the image, with each of the regions representing a single pixel of the image to be printed (or not printed) while the printhead 122 is aligned to the portion of the print medium 122. The microprocessor 136 determines whether or not to print each pixel based upon the determination of the portion of the print medium 112 to which the printhead 122 is aligned, and the position of each print element 120 in the printhead 122.

To actually print the desired portion of the image, the data bits or sequences of data bits retrieved from the memory location of the memory 154 corresponding to the particular pixels in the desired image portion are sent to the buffer 156 and clocked into a printer driver 158 under control of the microprocessor 136. The printer driver 158 then provides an energization signal to all of the print elements 120 in the printhead 122 through a printhead cable 160. In the thermal printhead of the preferred embodiment, the printer driver 158 includes current drivers and complementary logic components in accordance with conventional design.

The printer driver 158 is driven by the retrieved data in combination with a system clock signal under control of the microprocessor 136 to ensure proper timing and spacing of successive desired portions of the image to be printed. The microprocessor 136 controls the spacing of successive desired portions of the image by first monitoring the temporal spacing between successive increments of rotation of the print medium roll 116 to calculate the velocity of the print medium 112 past the printhead 122, averaged over several recent intervals. Based upon the average velocity, the microprocessor 136 estimates, in advance, when the printhead 122 will be aligned to each successive portion of the print medium 122. Based upon the calculation, the microprocessor 136 activates the printhead 122 before the portion of the print medium 112 to be printed actually reaches the printhead 122, so that the print elements 120 will have sufficient time to heat to a printing temperature before the portion of the print medium 112 passes the printhead 122.

As each individual print element 120 is heated, the region of the print medium 112 aligned to a particular print element is heated. The heat from the print element activates the thermally sensitive layer 112B of the print medium 122 and produces the desired portion of the printed image. Because the printhead 122 is mounted to the printed circuit board 126 which is movably mounted to the cover 106, the printhead can move radially inward toward the print roller 117 to accommodate decreases in the radius of the print medium roll 116 as the print medium 112 is consumed.

Figure 5:
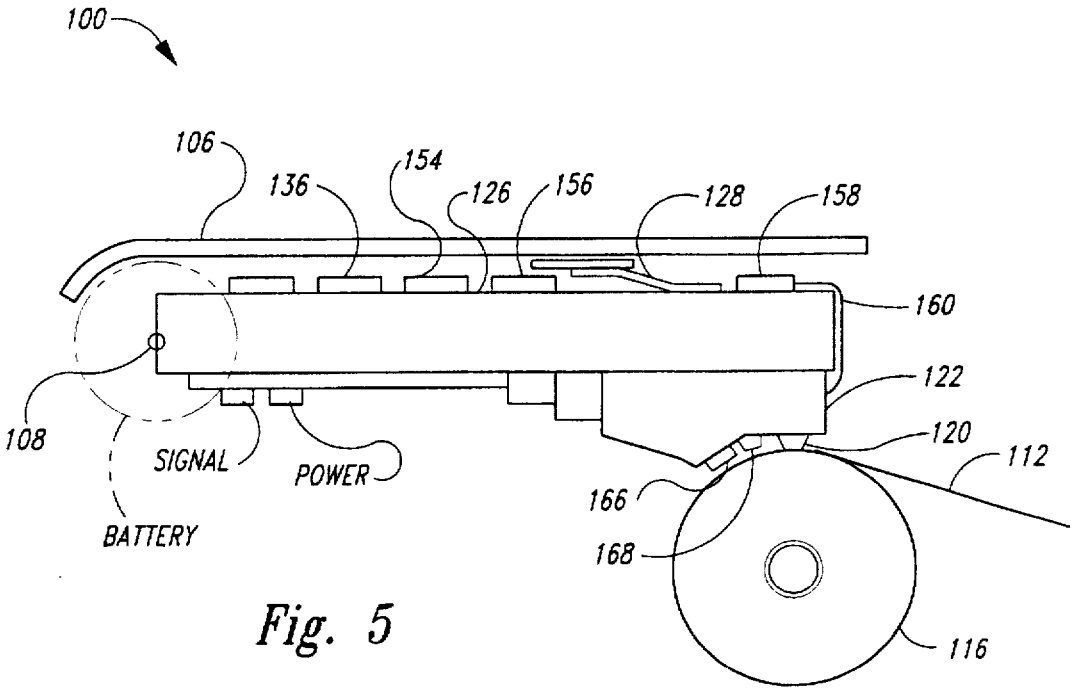
FIG. 5 is a schematic side elevational drawing of an alternative embodiment of the printer of FIG. 1 using optically detected index marks to monitor movement of the print medium roll.
Figure 6:
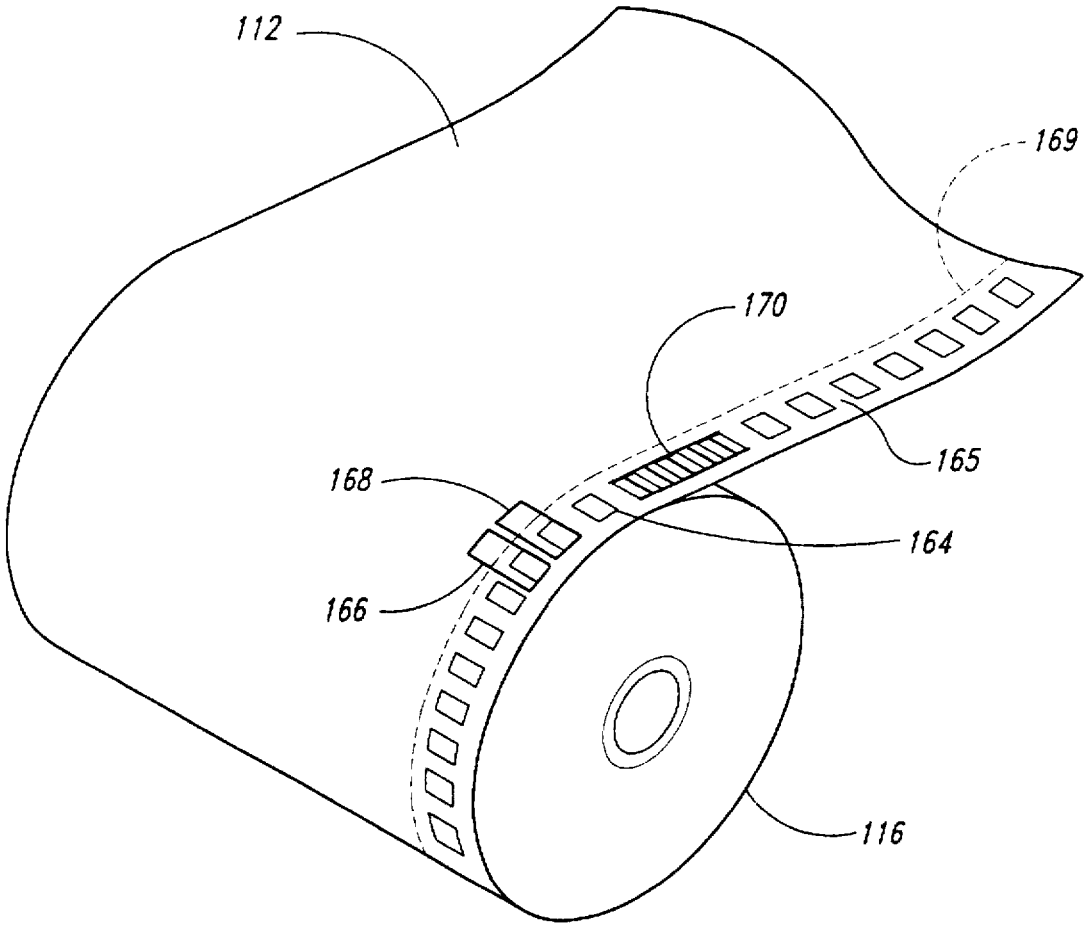
FIG. 6 is an enlarged isometric view of the print medium roll and an optical monitor of the printer of FIG. 5 showing index marks printed on the rolls.

An alternative embodiment of the printer 100 shown in FIG. 5 monitors movement of the print medium 112 by optically monitoring index marks 164 which are printed directly on the print medium 112 at evenly spaced locations along an edge region 169 of the print medium 112 with unmarked portions 165 therebetween, as shown in FIG. 6. To monitor movement of the index marks, the printer 100 includes an optical emitter 166 and detector 168. The emitter 166 and detector 168 are mounted to the printhead 122 and are thus carried by the printed circuit board 126 as it moves to accommodate changes in the radius of the print medium roll 116. The emitter 166 and detector 168 are fixedly mounted with the emitter 166 oriented to emit light toward the edge region 169 of the print medium 112 and the detector 168 positioned to detect light from the emitter 166 which is reflected from the edge region 169. Because the index marks 164 are areas of lower reflectance than the reflectance of the unmarked portions 165 therebetween, the intensity of light from the emitter 166 that is received will be more effectively reflected by the unmarked portions 165 of the edge region 169. Accordingly, the intensity of light received by the detector 168 will depend upon whether light from the emitter 166 strikes an index mark 164 or an unmarked portion 165 of the print medium 112.

As the print medium 112 is dispensed, the print medium roll 116 will rotate and the index marks 164 and unmarked portions 165 move past the emitter 166 and the detector 168. Light from the emitter 166 is alternately reflected by the unmarked portions 165 of the print medium 112 and absorbed by the index marks 164, causing the intensity of light received by the detector 168 to vary. In response to the alternating light, the detector 168 produces electrical signals corresponding to motion of the print medium 112 for input to the microprocessor 136 (FIG. 3). As with the embodiment of FIGS. 1–4, the microprocessor 136 monitors the signals from the detector 168 and calculates the distance traveled by the print medium 112 with reference to a selected starting point.

Advantageously, the print medium 112 in this embodiment bears a start-of-field mark 170 to indicate the start of a label or other selected printing field. When the microprocessor receives an electrical signal from the detector 168 corresponding to the start-of-field mark 170, the microprocessor 136 references subsequent movements to the start-of-field, identifying the image portion to be printed.

While the printer 100 is described herein as printing symbologies, such as bar code symbols or two-dimensional symbologies on labels, the printer may use other print media, such as paper from a paper roll or separate sheets of paper. The printer 100 may also be used to print other images such as text or graphics.

Also, the printhead 112 may be fixedly mounted on either of the base 104 or the cover 106 with the cover biased to pivot toward the base. As print medium 122 is consumed and the radius of the print medium roll 116 decreases, the cover 106 pivots toward the base 104, carrying the printhead 122 radially inward toward the print roll axle 117.

It will be appreciated that, although specific embodiments of the invention have been described herein for purposes of illustration, various modifications may be made without departing from the spirit and scope of the invention. For example, the index marks 164 may be read using ambient light in some environments. Similarly, the printhead 122 may be carried by the base 104 rather than the cover 106 and rotation of the print medium roll 116 may be monitored by directly monitoring rotation of the core 118. Accordingly, the invention is not limited except as by the appended claims.

We claim:

1. A printer for printing an image on thermally activatable print medium without using a platen roller, comprising:

a housing;

a print medium source having the print medium wound around a core located at a central axis of the print medium source, the core being supported by the housing and being rotatable about the central axis, the print medium wound around the core being dispensed as the core is rotated such that an outer winding of the print medium forms an outer surface of the print medium source; and a thermal printhead movably supported by the housing in thermal contact with the print medium source, the printhead being movable radially with respect to the central axis to maintain continuous thermal contact between the printhead and the outer winding for printing on the outer winding.

2. The printer of claim 1 wherein the housing includes:

a base portion carrying the print medium source; and a cover connected to the base and pivotable between an open position and a closed position, the cover carrying the printhead, the printhead being position such that when the cover is in the closed position, the printhead is engaged with the outer winding and when the cover is pivoted to the open position, the printhead is disengaged from the outer winding.

3. The printer of claim 2 further including:

a print medium monitor coupled to monitor movement of the print medium source, the print medium monitor producing an electrical signal indicative of the monitored movement;

a memory containing data corresponding to a portion of an image to be printed; and a microprocessor connected to receive the electrical signal from the print medium monitor and to retrieve data from the memory in response to the received signal, the microprocessor activating the printhead in response to the retrieved data and supplying the retrieved data to the printhead to print the portion of the image.

4. The printer of claim 3 wherein the print medium source is a print medium roll and the print medium monitor includes:

an encoder wheel coupled to rotate in correspondence with movement of the print medium; and an optical detector positioned to detect rotation of the encoder wheel and to produce the signal indicative of the monitored movement in response to the detected rotation of the encoder wheel.

5. The printer of claim 4 for use with a print medium bearing index marks, wherein the print medium monitor includes an optical detector for optically monitoring movement of the index marks.

6. A printer for printing an image onto an outer wrap of a print medium on a roll as the print medium is dispensed from the roll, the roll having a radius extending from a central axis of the roll, the radius decreasing as the roll is dispensed, comprising:

a printhead for printing on the outer wrap of the roll;

a first member carrying a roll mount, the roll mount supporting the roll and permitting rotation of the roll about the central axis; and a second member holding the printhead in position adjacent to outer wrap, the second member being movable to adjustably transport the printhead radially with respect to the central axis as the radius of the roll decreases to continuously maintain the printhead adjacent to the outer wrap for printing on the outer wrap.

7. The printer of claim 6 further including a pivotable connector intermediate the first and second members, wherein the first member extends radially in a first direction from the pivotable connector to the central axis and the second member extends radially in a second direction from the pivotable connector to the printhead at an angle from the first direction, the second member pivoting relative to the first member to position the printhead immediately adjacent the outer wrap as the radius of the roll decreases.

8. The printer of claim 7 further including a spring coupled between the second member and the printhead and positioned to provide a resilient engagement force to the printhead to move to the printhead radially inward toward the central axis, thereby continuously maintaining the printhead adjacent to the outer wrap.

9. The printer of claim 6 further including:

a print medium monitor coupled to monitor movement of the roll about the central axis to produce a signal corresponding to the monitored movement; and a microprocessor connected to receive the signal from the print medium monitor, the microprocessor activating the printhead in response to the received signal and supplying the retrieved data to the printhead.

10. The printer of claim 9 wherein the print medium monitor includes:

an encoder wheel coupled to rotate in response to movement of the roll about the central axis; and an optical detector positioned to detect rotation of the encoder wheel and to produce the signal corresponding to the monitored movement in response to the detected rotation of the encoder wheel.

11. The printer of claim 6 wherein the print medium includes a plurality of index marks spaced apart along the outer layer and wherein the print medium monitor includes an optical detector positioned to detect motion of the index marks as the roll rotates, the print medium monitor producing a signal in response to the detected motion.

12. The printer of claim 6 for use with a print medium bearing a start-of-field mark further including:

an optical detector positioned to detect the start-of-field mark, the optical detector producing a start-of-field signal in response to detecting the start-of-field mark; and an electronic controller connected to receive the start-of-field signal and to activate the printhead in response to the received start-of-field signal to print on the outer layer.

13. The printer of claim 6 for use with a linerless thermal print medium wherein the printhead is a thermal printhead.

14. A method of printing directly on an outer layer of a print medium on a print medium roll carried by a printer, the print medium roll including a plurality of wraps of the print medium, comprising the steps of:

rotatably mounting the print medium roll on a roll support with the outer layer exposed;

positioning a printhead in a printing position, adjacent to the outer layer and radially outward of the print medium roll;

grasping an end portion of the print medium;

pulling the end portion to cause the print medium roll to rotate on the roll support and dispense the outer layer;

monitoring movement of the outer layer to determine a portion of the outer layer aligned with the printhead;

selecting an image portion corresponding to the determined portion of the print medium; and activating the printhead when the determined portion is located adjacent the printhead to print the selected image portion on the determined portion of the print medium.

15. The method of claim 14, wherein the step of monitoring movement of the outer layer comprises the steps of:

frictionally engaging the outer layer with a metering roller, with the metering roller turning in correspondence with movement of the outer layer;

detecting the rotation of the metering roller as the metering roller turns; and calculating the distance moved by the outer layer in response to the detected rotation of the metering roller.

16. The method of claim 15 wherein the printhead is a thermal printhead and the step of activating the printhead includes providing an electrical energization signal to the printhead to cause the printhead to heat.

17. The method of claim 14 wherein the outer layer includes a plurality of spaced apart index marks and the step of monitoring movement of the outer layer includes the steps of:

optically detecting movement of the index marks to produce an electrical signal indicative of movement of the index marks; and determining movement of the outer layer in response to the electrical signal indicative of movement of the index marks.

18. The method of claim 14 wherein the printer includes a cover pivotable between an open position and a closed position, the cover carrying the printhead, wherein the step of positioning the printhead in a printing position comprises pivoting the cover to the closed position.

19. A method of printing directly on an outer layer of a print medium on a print medium roll carried by a printer, the print medium roll including a plurality of wraps of the print medium, comprising the steps of:

rotatably mounting the print medium roll on a roll support with the outer layer exposed;

positioning a printhead in a printing position, adjacent to the outer layer and radially outward of the print medium roll;

grasping an end portion of the print medium;

pulling the end portion to cause the print medium roll to rotate on the roll support and dispense the outer layer;

monitoring movement of the outer layer to determine a portion of the outer layer aligned with the printhead, including frictionally engaging the outer layer with a metering roller, with the metering roller turning in correspondence with movement of the outer layer, detecting the rotation of the metering roller as the metering roller turns, and calculating the distance moved by the outer layer in response to the detected rotation of the metering roller;

selecting an image portion corresponding to the determined portion of the print medium; and activating the printhead when the determined portion is located adjacent the printhead to print the selected image portion on the determined portion of the print medium.

20. A method of printing directly on an outer layer of a print medium on a print medium roll carried by a printer, the print medium roll including a plurality of wraps of the print medium, comprising the steps of:

rotatably mounting the print medium roll on a roll support with the outer layer exposed;

positioning a thermal printhead in a printing position, adjacent to the outer layer and radially outward of the print medium roll;

grasping an end portion of the print medium;

pulling the end portion to cause the print medium roll to rotate on the roll support and dispense the outer layer;

monitoring movement of the outer layer to determine a portion of the outer layer aligned with the printhead;

selecting an image portion corresponding to the determined portion of the print medium; and providing an electrical energization signal to the printhead to cause the printhead to heat when the determined portion is located adjacent the printhead to print the selected image portion on the determined portion of the print medium.

21. A method of printing directly on an outer layer of a print medium on a print medium roll carried by a printer, the print medium roll including a plurality of wraps of the print medium, comprising the steps of:

rotatably mounting the print medium roll on a roll support with the outer layer exposed, wherein the outer layer includes a plurality of spaced apart index marks;

positioning a printhead in a printing position, adjacent to the outer layer and radially outward of the print medium roll;

grasping an end portion of the print medium;

pulling the end portion to cause the print medium roll to rotate on the roll support and dispense the outer layer;

monitoring movement of the outer layer to determine a portion of the outer layer aligned with the printhead, including optically detecting movement of the index marks to produce an electrical signal indicative of movement of the index marks, and determining movement of the outer layer in response to the electrical signal indicative of movement of the index marks;

selecting an image portion corresponding to the determined portion of the print medium; and activating the printhead when the determined portion is located adjacent the printhead to print the selected image portion on the determined portion of the print medium.

22. A method of printing directly on an outer layer of a print medium on a print medium roll carried by a printer, the print medium roll including a plurality of wraps of the print medium, and the printer including a cover pivotable between an open position and a closed position, comprising the steps of:

rotatably mounting the print medium roll on a roll support with the outer layer exposed;

positioning a printhead in a printing position, adjacent to the outer layer and radially outward of the print medium roll, including positioning the printhead in a printing position comprising pivoting the cover to the closed position, wherein the cover carries the printhead;

grasping an end portion of the print medium;

pulling the end portion to cause the print medium roll to rotate on the roll support and dispense the outer layer;

monitoring movement of the outer layer to determine a portion of the outer layer aligned with the printhead;

selecting an image portion corresponding to the determined portion of the print medium; and activating the printhead when the determined portion is located adjacent the printhead to print the selected image portion on the determined portion of the print medium.

* * * * *